US006907622B2

(12) United States Patent
Rasaei et al.

(10) Patent No.: US 6,907,622 B2
(45) Date of Patent: Jun. 21, 2005

(54) FLUSHING DEVICE FOR TOILETS

(76) Inventors: Eskandar Rasaei, 16700 Chatsworth St. #01, Granada Hills, CA (US) 91344; Misha Rasaei, 19340 Stillmore St. #152, Canyon Country, CA (US) 91351

( * ) Notice: Subject to any disclaimer, the term of this patent is extended or adjusted under 35 U.S.C. 154(b) by 295 days.

(21) Appl. No.: 10/201,048

(22) Filed: Jul. 23, 2002

(65) Prior Publication Data

US 2004/0016047 A1 Jan. 29, 2004

Related U.S. Application Data

(63) Continuation of application No. 09/933,084, filed on Aug. 20, 2001, now abandoned.
(60) Provisional application No. 60/233,721, filed on Sep. 19, 2000.

(51) Int. Cl.[7] ..... E03D 9/00
(52) U.S. Cl. ..... 4/255.06; 4/255.04; 4/225.07
(58) Field of Search ..... 4/255.04, 255.06, 4/255.01, 225.07

(56) References Cited

U.S. PATENT DOCUMENTS 2,733,450 A * 2/1956 Wallace, Sr. ..... 4/255.06
3,608,098 A * 9/1971 Andrisani ..... 4/255.04
6,163,895 A * 12/2000 Davenport ..... 4/255.06

* cited by examiner

*Primary Examiner*—LoAn H. Thanh
*Assistant Examiner*—Lina R Kontos
(74) *Attorney, Agent, or Firm*—Roger A. Marrs

(57) ABSTRACT

A flushing device for toilets includes a source for applying a fluid pressure to a blockage area and provides a seal in the blocked conduit to prevent backflow so that full pressure is applied to the blockage. The device includes a resilient, deformable and expandable element secured at the end of a tubular member which is inserted into a toilet conduit leading to the drain line. The tubular member has a coupling at its end opposite to the end carrying the expandable element to which a hose is connected in order to alternately supply pressurized water to the element or to the conduit. The expandable element is carried on a linear portion of the tubular member adjacent to the discharge orifice thereof and is expanded into a sealing condition with the conduit entrance leading into the drain line. The exterior surface of the expandable element is provided with spaced-apart ridges and grooves that are deformable to provide a positive sealing relationship with the entrance of the conduit so as to completely seal the entrance. A valve mechanism is disposed between the tubular member and a pipe connected to the element for user selection of fluid supply to either the element or to the drain conduit.

3 Claims, 3 Drawing Sheets

FLUSHING DEVICE FOR TOILETS

This appln is a con of Ser. No. 09/933,054 Aug. 20, 2001 abandoned which claims benefit of provisional appln. Ser. No. 60/233,721 Sep. 19, 2000.

BACKGROUND OF THE INVENTION

1. Field of the Invention

The present invention relates to the field of devices for unblocking toilet conduits, and more particularly to a novel device insertable into the downstream portion of a toilet conduit which includes means for sealing the conduit and for flushing the conduit clear of any blockage material that may clog or prevent the flow of fluid through the conduit.

2. Brief Description of the Prior Art

In the past, it has been the conventional practice to alleviate blockage in toilets and/or drain lines by using a toilet plunger of the type comprising a flexible plunger element at one end of an elongated, rigid handle which is inserted into the conduit or drain line and pumped mainly to clear the blockage. Also, such resilient deformable plungers have been attached to tubular handles which are then connected via a shutoff value and check valve to a pressurized source of water. Upon setting the valves, the pressurized water is conducted through the tubular handle and is introduced to the conduit or drain line for applying increased pressure to any blockage or obstruction in the drain line. Such a conventional device is described in U.S. Pat. No. 4,768,237.

Difficulties and problems have been encountered with conventional toilet plungers and unblockage devices which stem largely from the fact that the deformable plunger element is used in combination with or without the pressurized water to effect unblockage of the drain line and the plunger does not form an effective seal in the conduit whereby backflow is prevented. Also, since an inadequate seal is present, loss of pressure is experienced which makes the job of unblocking the conduit more difficult. Additionally, such systems require valving which in itself may clog and require maintenance.

Therefore, a long-standing need has existed to provide a novel means for unblocking conduits and removing obstructions in the conduit which not only provides adequate pressure as a positive force but includes means for sealing the conduit ahead of the blockage so that full pressure is applied thereto.

SUMMARY OF THE INVENTION

Accordingly, the above problems and difficulties are avoided by the present invention which provides a novel flushing device for toilets which not only applies increased pressure to the blockage area but provides a seal in the conduit to prevent backflow and insures full pressure being applied to the blockage. The device includes a resilient deformable, expandable or inflatable sealing element which is secured at the end of a tubular member or handle and is intended to be inserted into the opening of a toilet conduit leading to the drain line. The tubular member or handle is provided with a coupling at its end opposite to the end carrying the sealing element to which a hose and on/off closure is connected in order to supply pressurized water through the tubular member or handle for discharge through an open orifice. The sealing element is carried on a linear portion of the tubular member or handle adjacent to the discharge orifice and is adapted to be expanded either by introduction of the pressured water or by applied air pressure into a sealing condition with the conduit entrance leading into the drain line. The exterior surface of the sealing element is provided with spaced-apart ridges and grooves that are deformable in order to provide a positive sealing relationship with the entrance of the conduit so as to completely seal the entrance.

A manual or hand pump is carried on the tubular member or handle and includes a hand-operated piston carried in a cylinder for conducting pressurized air through a pipe to the interior cavity of the inflatable element. By introducing pressurized air to the inflatable element, the central portion of the sealing element is expanded into sealing relationship with the entrance of the conduit.

Another version includes eliminating the handpump in favor of a valve means for selectively supplying pressurized water to either the inflatable or expandable sealing element or to the drain line. The valve means is installed on the tubular member and a tube or pipe is coupled between the valve means and the interior of the expandable sealing element or bladder so the element may employ the same pressure source as the drain unclogging conduit.

Therefore, it is among the primary objects of the present invention to provide an improved toilet flushing device which is connectable to a supply of pressurized fluid for applying increased pressure to obstruction in drain lines or the like and which includes sealing means for preventing backflow and for providing increased pressure to blockage or obstructions in the drain line.

Another object of the present invention is to provide a toilet unblocking device which is connectable to a supply of pressurized fluid for simultaneously increasing pressure to remove blockage or obstruction in the drain line as well as to seal in a positive manner, the entrance leading into the drain line ahead of the blockage, so as to increase pressure for blockage and obstacle removal.

Still a further object of the present invention is to provide a novel flushing device for toilet drain or conduit lines which includes an expandable sealing element at one end of the tubular member through which pressurized water is conducted for discharge into the expandable element or into the drain line after the element has been inflated into a sealing relationship.

Still a further object of the invention resides in providing a combined sealing and increased pressure device for flushing obstacles and blockages from drain lines or the like.

Yet another object resides in providing a universal pipe opener which employs utilizing high pressure air or water as a fluid to expand a sealing element and/or to open and clear blockage within a toilet drainage pipe or conduit.

A further object including a pipe or conduit sealing element or head which expands by application of pressurized air or water to firmly seal the pipe or conduit at a given location so as to apply increased pressure to an obstruction downstream.

Another object resides in providing an irregular contour to a pipe or conduit sealing element or head which firmly grips and seals with the wall of the blocked conduit that prevents backflow and provides increased application of pressure to the blockage or obstruction.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENTS

Figure 1:
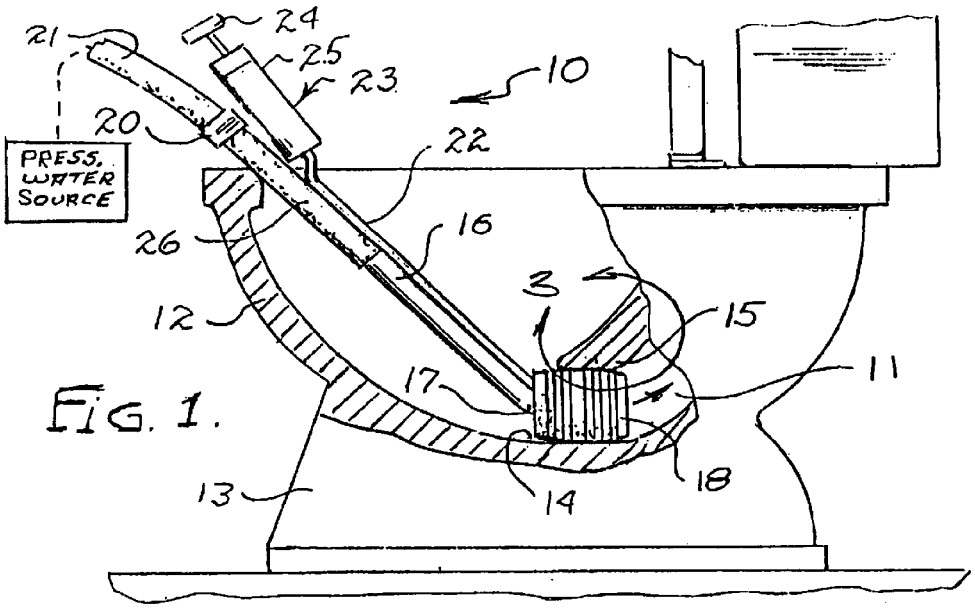
FIG. 1 is a side elevational view of the novel flushing device incorporating the present invention and illustrated as being installed in a typical toilet drain line or conduit.

Referring to FIG. 1, the novel flushing device for toilets is illustrated in the general direction of arrow 10 and is illustrated in position to seal the entrance to a drainage pipe or conduit 11 formed in a basin 12 of a toilet 13. The basin 12 includes an orifice 14 which is defined by a sidewall of the drainage pipe or conduit 11 and a projection 15 which is integrally formed with the bowl 12.

The device 10 includes an elongated tubular handle 16 having an outwardly projecting portion 17 on which an expandable and inflatable means or element 18 is secured. The opposite end of tubular handle 16 terminates in a coupling 20 to which a flexible hose 21 is attached. The opposite end of hose 21 is connected to a suitable pressurized fluid such as water or air so that the pressurized fluid is introduced through the tubular handle 16 for discharge into the drainage pipe or conduit 11. Furthermore, the tubular handle 16 supports an elongated pipe 22 which is coupled at one end to a manual hand pump 23 that provides air under pressure to the interior of element 18 so that it can be expanded into sealing relationship to close the entrance to conduit 11. The hand pump 23 includes a hand-operated piston assembly 24 which is housed by a cylinder 25. A cushion sleeve 26 covers a portion of the tubular handle 16 which increases the gripping condition so that the device can be easily handled by the user. The sleeve 26 prevents slipping when grasped by the hand of the user.

Figure 2:
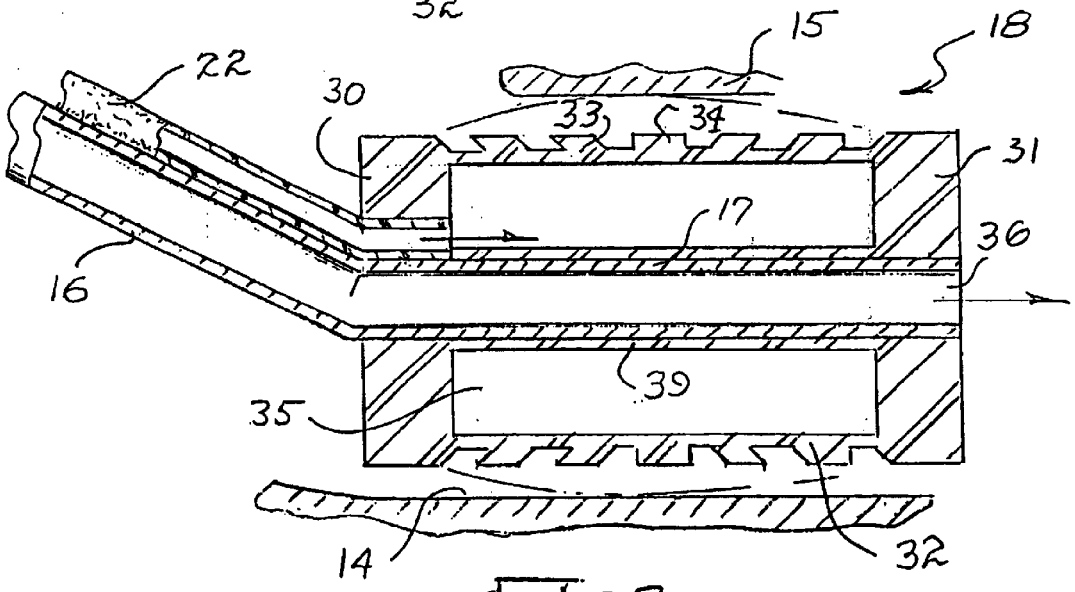
FIG. 2 is a greatly enlarged longitudinal cross-sectional view of the sealing element carried on the end of a tubular member or handle as employed in the embodiment shown in FIG. 1.

Referring now in detail to FIG. 2, it can be seen that the expandable and inflatable element 18 is of a cylindrical configuration when not inflated and that the opposite ends of the element include thickened end portions 30 and 31 respectively. Connecting the end portions is a pliable and expandable member or wall of reduced thickness, as indicated by numeral 32, which is integrally formed with the thicker end portions 30 and 31. The member or wall 32 includes an external surface which is provided with a plurality of spaced-apart grooves and pliable ridges or ribs, such as laterally sloping ridge or rib 33 and middle or central rib or ridge 34. The interior of element 18 is an enclosed cavity, represented by numeral 35, which is inflated by pressurized air dispensed through tube or pipe 22. As the pressure builds within the cavity 35, the member 32 will expand into sealed relationship with the opening to conduit 11 by bearing against surfaces 14 and 15. Such a sealing relationship is illustrated in broken lines when the member 32 has been expanded. It can also be seen in FIG. 2 that the tubular handle 16 terminates into the linear portion 17 which includes an open discharge orifice 36 for introducing a pressurized fluid such as air or water into the drainage pipe or conduit 11.

Figure 3:
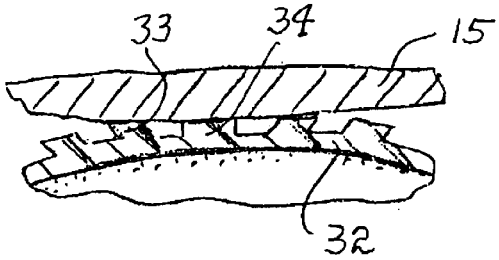
FIG. 3 is a fragmentary sectional view of the sealing element illustrated in its inflated condition so as to provide a seal with the entrance of the toilet drain or conduit.

Referring now to FIG. 3, it can be seen that the member 32 is expanded so that the ridges represented by lateral ridges 33 and center ridge 34 bear against opposing conduit surfaces leading into conduit or pipe 11.

The hand pump 25 along with tube 22 may be carried by the tubular handle in any convenient fashion. Clips, clamps or other retainers may be used to combine the pump and pipe to the handle. The inflatable element 18 may be attached to end portion 17 by adhesive between a mounting sleeve 39 integrally formed with the end portions 30 and 31 with the external surface of tube portion 17.

Therefore, in view of the foregoing, it can be seen that should blockage occur downstream from the entrance of conduit 11, the flushing device of the present invention may be employed to force the blockage or obstruction from the conduit. Initially, the coupling 20 is connected to either a high pressure through its source of water or air after the expandable element 18 has been properly seated and inflated into a sealing position at the entrance to the conduit. By introducing pressurized water or air through the tubular handle 16, the pressurized fluid is discharged from orifice 36 into the conduit or pipe 11. A positive seal is produced between the element 18 and the entrance to the conduit by means of the ribbed exterior which is not only expanded to close off the entrance but is expanded under pressure so that a positive force is in place against the opposing surfaces of the entrance to the conduit. The device is greatly simplified by employing a hand-operated piston and cylinder assemblage for introducing pressurized air to the cavity 35 of the expandable element 18. Therefore, it can be seen that a universal pipe or conduit flushing device is provided which will open a blocked or obstructed conduit which employs utilizing pressurized water or air to open the blockage. It is particularly useful in connection with a toilet drainage pipe or conduit.

The device's expandable element is employed for positively sealing the entrance to the drain line or conduit so as to prevent any backflow of fluids or air through the drain line. Thus, increased pressure is applied to a blockage or obstruction on the outlet portion of a toilet or in a drain line by supplying pressurized water or air through the tubular handle. The sealing section of the expandable member can be functional through various means such as a regular hand pump, a built-in air gun or a hand or foot pedal device. All of these means are to apply fluid pressure such as air to the expandable element to assure complete sealing of the entrance to the drain line.

Figure 4:
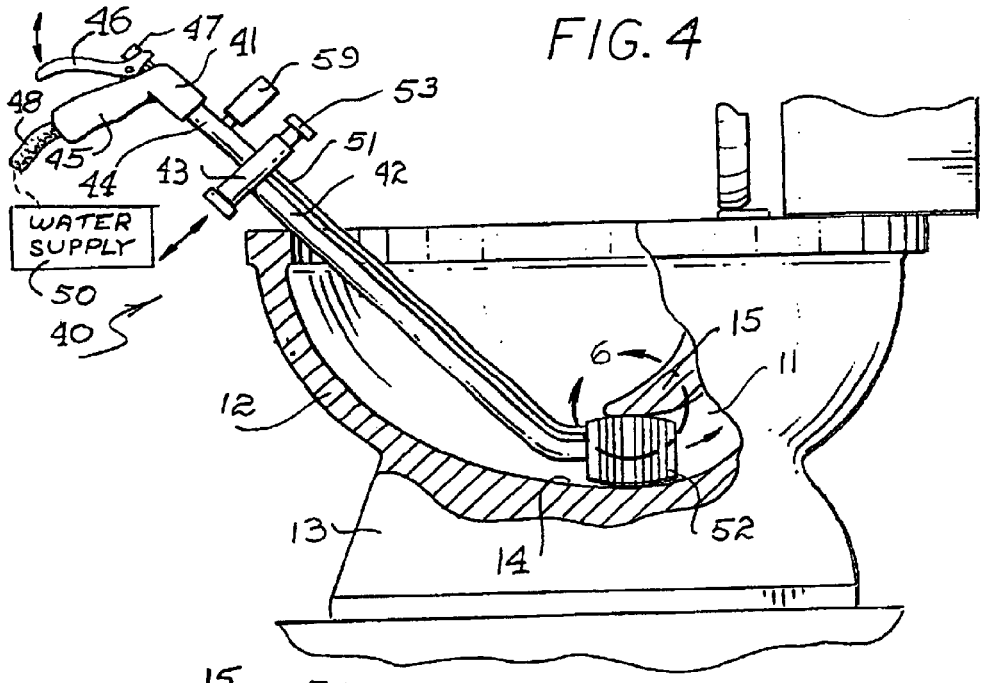
FIG. 4 is a side elevational view of another version of the present invention utilizing a common pressure source for expanding the sealing element and for supplying pressure to the downstream blockage.

Referring now to FIG. 4, another embodiment of the present invention is illustrated in the general direction of arrow 40 which is illustrated in position to seal the entrance to a drainage pipe or conduit 11 formed in basin 12 of a toilet 13. As previously described with respect to the embodiment shown in FIG. 1, the basin 12 includes an orifice 14 which is defined by a sidewall of the drainage pipe or conduit 11 and a projection 15 which is integrally formed with the bowl 12.

The flushing device 40 includes a handle 41 attached to one end of an elongated tubular member 42 via a valve means 43 and a connector to 44. The handle 41 includes a pistol-grip 45 and a palm-operated lever 46 that is operably connected to a closure valve within the handle 41 and includes a plunger 47 that opens and closes the valve in handle 41 as the lever 46 is pivoted when compressed against the grip 45. The end of the handle 41 is connected via a hose 48 to a water supply 50. It is to be understood that the water supply is pressurized and will provide pressurized water through the handle 41 and the tube 44 to the tubular member 42 when the lever 46 has been compressed and the valve within handle 41 opened by plunger 47.

It can also be seen that the valve means 43 is connected to one end of a pipe 51 having its opposite end coupled to the sealing member 52. Therefore, both the pipe 51 and the tubular member 42 are connected for discharge either into the expandable chamber 56 of the sealing member 52 or through the sealing member 52 for exhausting into the drainage conduit 11. The operation and significance of the sealing member 52 is the same as previously described with respect to the sealing member 18. It is also to be understood that the water supply 50 may take the form of a pressurized air supply from a pressure cylinder or the like. The intermediate conduit 44 serves to mount a gauge 59 which indicates the amount of pressure or volume of fluid being dispensed through the intermediate tube 44 preceding introduction to the valve 43.

Figure 6:
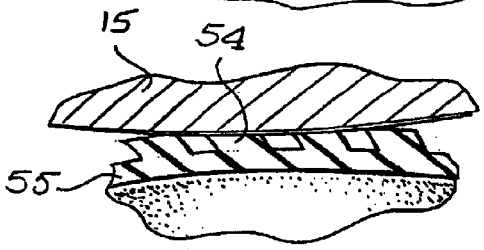
FIG. 6 is a fragmentary sectional view of the sealing element in its expanded condition.

It is to be noted that the valve means 43 includes a plunger 53 which moves in a rectilinear direction through the body of the valve in accordance with the arrows adjacent to the valve means. The position of the plunger 53 determines whether the pressurized fluid supply, whether it be water or air, is introduced to either pipe 51 or tubular member 42. In actual operation, the plunger 53 is placed in a position so that the pressurized water source is conducted through pipe 41 to the interior of the sealing means 52 so that its external surface will expand and not only engage with the surface of projection 15 and 14 but will form a clamping relationship as previously described. Such a sealing condition is shown in FIG. 6 and it an be seen that the plurality of ribs, such as rib 54, deform to provide a tight sealing relationship with the projection 15. The plurality of ribs are separated by grooves or spaces so that the ribs can readily deform when compressed due to the expansion of the wall 55.

Figure 5:
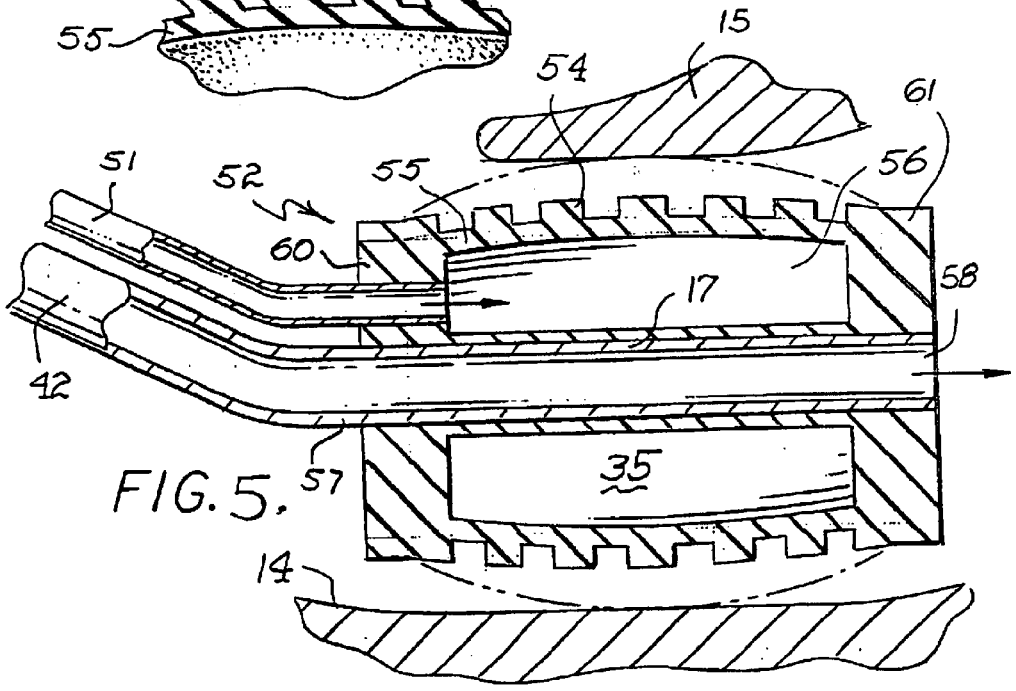
FIG. 5 is an enlarged longitudinal cross-sectional view of the expandable sealing element, as shown in FIG. 4.

In FIG. 5, the sealing element 52 is illustrated in its deflated or normally not expandable position in solid lines whereas the expandable position is shown in broken lines. It can be seen in FIG. 5 that the pressurized fluid introduced from pipe 51 goes to an interior toroidal chamber 56 which causes the walls 55 of the sealing member to expand as previously described. Upon achieving a proper seal, the valve plunger 53 is moved to an alternative position so that the pressurized fluid is then conducted from the tubular member 42 through a linear portion of the tube 57 exiting from an orifice 58 into the drain 11. The opposite ends of the sealing member or element, represented by numerals 60 and 61, are relatively rigid and non-expandable as compared to the connecting wall 55 and the ribs 54.

Figure 7:
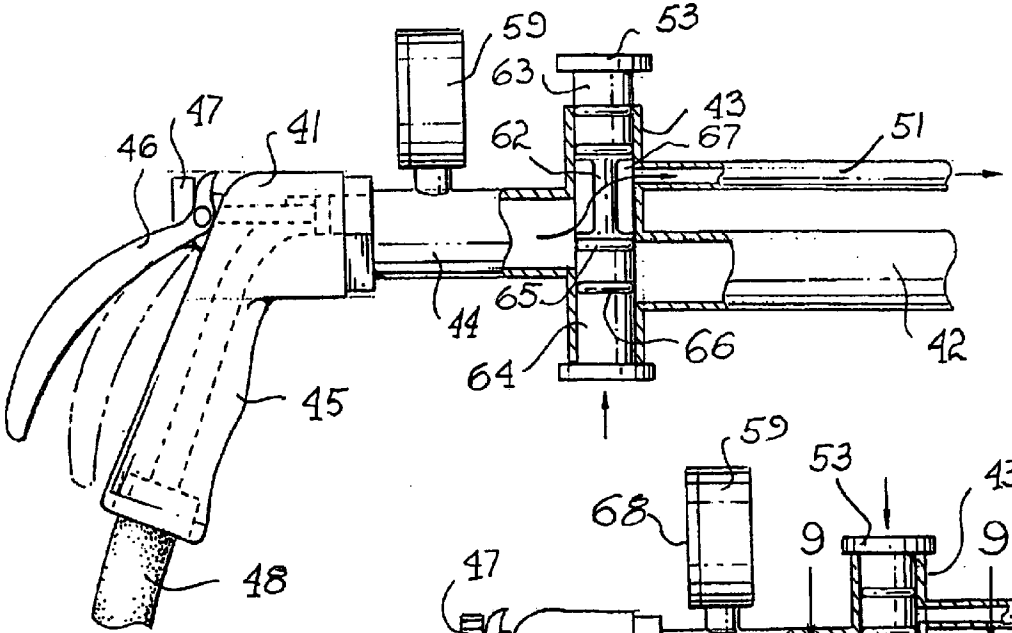
FIG. 7 is an enlarged side elevational view of the valve mechanism employed in the flushing device shown in FIG. 4.
Figure 8:
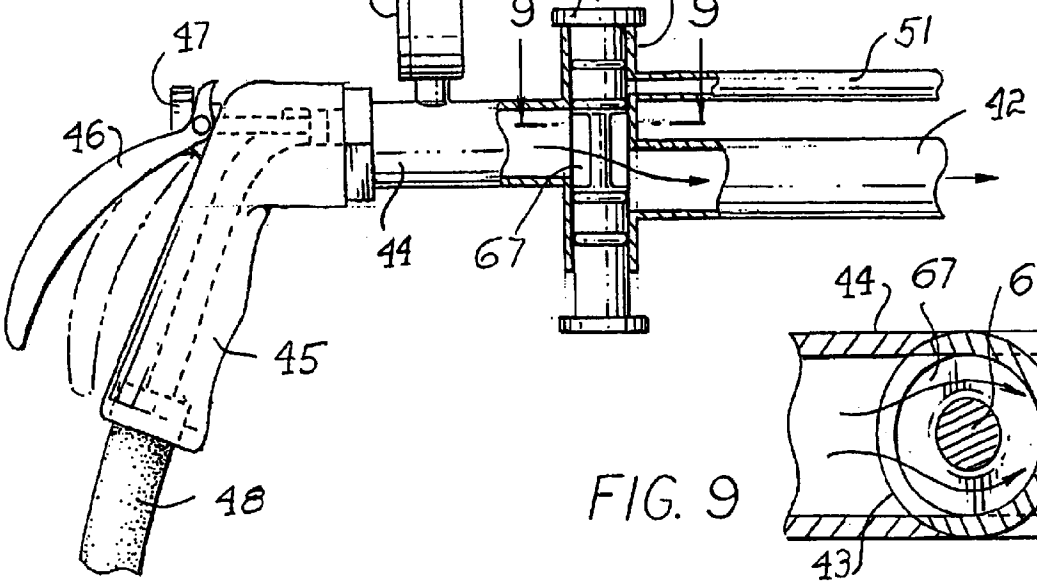
FIG. 8 is a view similar to the view of FIG. 7 showing the valve mechanism in an alternate position.

Referring now in detail to FIG. 7, it can be seen that the valve means includes the plunger 53 which moves in a rectilinear direction within the body 43. The plunger includes a central post 62 of reduced diameter in comparison with end portions 63 and 64 respectively. The end portions 63 and 64 each include a pair of O-Ring seals indicated by numeral 65 and 66 with respect to portion 64. The reduction of diameter for post 62 provides a valve chamber which is circular or toroidal and indicated by numeral 67. When the plunger 53 is in the position shown in FIG. 7, the bore or passageway of connector tube 44 is in communication with the valve chamber 67 which is also in communication with the bore of pipe 51. Therefore, when the hand lever 46 is depressed, pressurized water from the hose 48 will be introduced to the pipe 51 and employed to expand the expandable element 52. However, when the plunger is in the position shown in FIG. 8, the internal passageway or bore of tube 44 is in communication not only with the valve chamber 67 but the internal passageway of tube 42. Therefore, the pressurized fluid, such as water, will be introduced to the drain conduit 11 from the exhaust or nozzle 58 in the expandable element. The meter 52 will indicate an amount or degree of pressure or volume of water being supplied on the front face of the dial 68.

Figure 9:
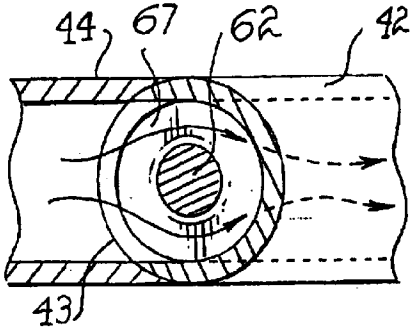
FIG. 9 is a fragmentary, cross-sectional view of the valve mechanism as taken in the direction of arrows 9—9 of FIG. 8.

Referring now in detail to FIG. 9, it can be seen that the post 62 is in the center of the valve chamber 67 and that the chamber is circular in plan view and will permit passage of the pressurized fluid, such as water, as indicated by the arrows. Whether the plunger is raised or lowered will determine whether the pressurized flow will be introduced into the pipe 51 or the tube 42.

In view of the foregoing it can be seen that the valve means having body 43 for slidably mounting plunger 53 will control the flow of pressurized fluid between the pipe 51 and tube 42. Thus, the user may expand the expandable element 52 first, followed by moving the valve plunger in an opposite direction to close one port such as the port leading to pipe 51, while the valve chamber is now open to pass the pressurized fluid through the expandable element for discharge into the drain 11. The solid portions 63 and 64 serve as closures between the alternative positions of the plunger to restrict flow to either the pipe 51 or tube 42. The valve means is manually operated by the user and may include indicia on the external surface of the body 43 in order to indicate position of the plunger to conduct the pressurized fluid to either pipe 51 or tube 42. The user may actuate the handle 46 with respect to the grip 45 in order to supply the pressurized fluid to the interconnecting tube 44 or to close off the supply. The indicator 68 on the front of the gauge 59 will advise the user on pressure or volume of the pressurized fluid.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A blockage clearance device for a toilet conduit comprising:

a pair of elongated tubes, each of said tubes having opposite ends disposed between an internal passageway;

an expandable element secured on a selected end of said tubes and said element having an internal cavity with a selected one of said tubes connected therewith;

a source of pressurized fluid in communication with said tubes for introducing pressurized fluid to said internal cavity of said expandable element or to a toilet drainage conduit;

said expandable element adapted to radially expand to close and seal with said toilet drainage conduit in response to introduction of said pressurized fluid;

a single valve operably carried on said tubes for alternately conducting said pressurized fluid to either said internal cavity or to said toilet drainage conduit;

said single valve having a housing with an input port and with a first output port communicating with said passageway of said tube connected to said internal cavity and a second port communicating with said passageway of said tube connected with said toilet drainage conduit;

a manually operated plunger in said housing having a first chamber and a second chamber and movable within said housing to conduct pressurized fluid from said source of pressurized fluid to either said first output port or to said second output port;

said source of pressurized fluid detachably coupled to said input port of said housing for alternatively supplying said pressurized fluid to flow through either said first or said second output port to forcibly expand said expandable element or to clear said toilet drainage conduit;

said expandable element includes an outer exterior surface carrying a plurality of spaced-apart ribs deformable upon compression to provide a sealing relationship with said toilet drainage conduit; and said selected end of said tube having an outwardly projecting linear end portion supporting and mounting said expandable element.

2. A blockage clearance device for a toilet drain comprising:

an expandable element having a cylindrical wall expandable between a first non-sealing position and a second sealing position;

said element having an internal cavity defined by a pair of end sections connected together by said cylindrical wall;

said internal cavity constituting a pressure chamber;

said element further having a central bore separated from said internal cavity and extending through said element and said end sections respectively;

a pair of elongated fluid-carrying conduits with a selected one being a pipe and a non-selected one being a tube;

a single valve selectively connected to a selected end of said conduits for alternatively conducting pressurized fluid to either said pipe or said tube;

a source of pressurized fluid coupled to said single valve;

said single valve includes a body having a first output port and a second output port connected with said pipe and said tube respectively and an input port connected to said source of pressurized fluid and said body further enclosing a manually operated plunger movable in a rectilinear direction to alternately supply said pressurized fluid to either said pipe via said first output port or said tube via said second output port;

said pipe having an end opposite to said end connected to said single valve terminating with said internal cavity of said element; and said tube having an end opposite to said end connected to said single valve terminating with said central bore.

3. The blockage clearance device defined in claim 2 wherein:

said plunger includes a central section of reduced dimension so as to define a circular or toroidal chamber for conducting said pressurized fluid to a selected one of said output ports; and said plunger further having end sections separated by said central section and said circular or toroidal chamber for blocking either one of said output ports.

* * * * *